United States Patent [19]

Faull

[11] 4,191,355

[45] Mar. 4, 1980

[54] ROCKER FIXTURES

[76] Inventor: James K. Faull, Rte. 1, Box 156, Enon Valley, Pa. 16120

[21] Appl. No.: 915,821

[22] Filed: Jun. 15, 1978

[51] Int. Cl.[2] ..... F16M 13/00

[52] U.S. Cl. ..... 248/594; 248/596; 297/300; 297/305; 297/326

[58] Field of Search ..... 248/382–385; 297/300–306, 326, 327

[56] References Cited

U.S. PATENT DOCUMENTS

| | | | |
|---|---|---|---|
| 2,420,745 | 5/1947 | Harman | 297/301 |
| 2,463,257 | 3/1949 | Fox | 297/301 |
| 2,528,223 | 10/1950 | Fox | 297/301 |
| 3,672,721 | 6/1972 | Williams | 297/302 |

*Primary Examiner*—James C. Mitchell
*Attorney, Agent, or Firm*—Michael Williams

[57] ABSTRACT

A rocker fixture for attachment to the bottom of a chair seat to provide a swivel and rocking action. The fixture comprises an upright post having its lower end received in swivel manner in the usual center socket carried by the legs of the chair. The upper end of the post is secured to a head bracket which has pivot connection with the legs of a channel, the latter being secured to a plate which is attached to the under-side of the chair seat. A bell crank lever is also pivotally connected between the legs of the channel and has one arm slidably engageable with an extension of the head bracket, and the other arm is acted upon by a spring-controlled member to urge said one arm to engagement with said bracket extension. The rocking action of the fixture works on a counter-balance principle so that weight shifting is required to tilt both to a backward position and forward from such position.

11 Claims, 4 Drawing Figures

ROCKER FIXTURES

BACKGROUND AND SUMMARY

Rocker fixtures of various forms have been heretofore used, particularly in furniture for office use, and examples may be found in U.S. Pat. No. 2,463,257, issued to M. Fox on Mar. 1, 1949, and U.S. Pat. No. 3,672,721, issued to P. J. Williams on June 27, 1972. In the Fox patent, for example, a head is secured to the upper end of a post, the head having a portion pivotally connected to the bottom of a chair seat. A bell crank is pivotally connected to the head and has one arm connected to the bottom of a chair seat and another arm in engagement with one end of a compression spring. This general construction has been widely used but its tilting action was tiring to the user since weight had to be constantly applied to the chair seat and back to hold the seat in a selected tilted position.

A later Fox patent, U.S. Pat. No. 3,053,570, and a patent to Underdown, U.S. Pat. No. 3,190,693, disclose sheet-metal rockers between the chair base and seat and these constructions are relatively expensive and subject to noisy rocker action.

My improved rocker fixture is relatively low in cost of manufacture, is noiseless and eliminates the feeling of being pushed into an upright position by spring action.

The components of my fixture may be formed of relatively light-guage sheet metal, and include a head bracket secured to the upper end of the seat post and a bell crank lever, both bracket and lever being pivotally mounted in spaced relation on a channel member which is fixed to the underside of the chair seat. The bracket and lever have cooperating parts which slidingly engage each other during rocking action of the chair.

DESCRIPTION OF THE DRAWINGS

In the drawings accompanying this specification and forming a part of this application, there is shown, for purpose of illustration, an embodiment which my invention may assume, and in these drawings.

DESCRIPTION OF THE PREFERRED EMBODIMENT

A top plate 10, of any desired configuration, is adapted to be secured to the underside of the chair seat shown by the numeral 11 in broken lines. The plate is formed of sheet metal and is preferably rectangular in plan view so that corners thereof may be apertured to pass screws 12 to secure the plate to the chair seat. The plate may be formed with an annular rib 14 to impart rigidity thereto.

Figure 1:
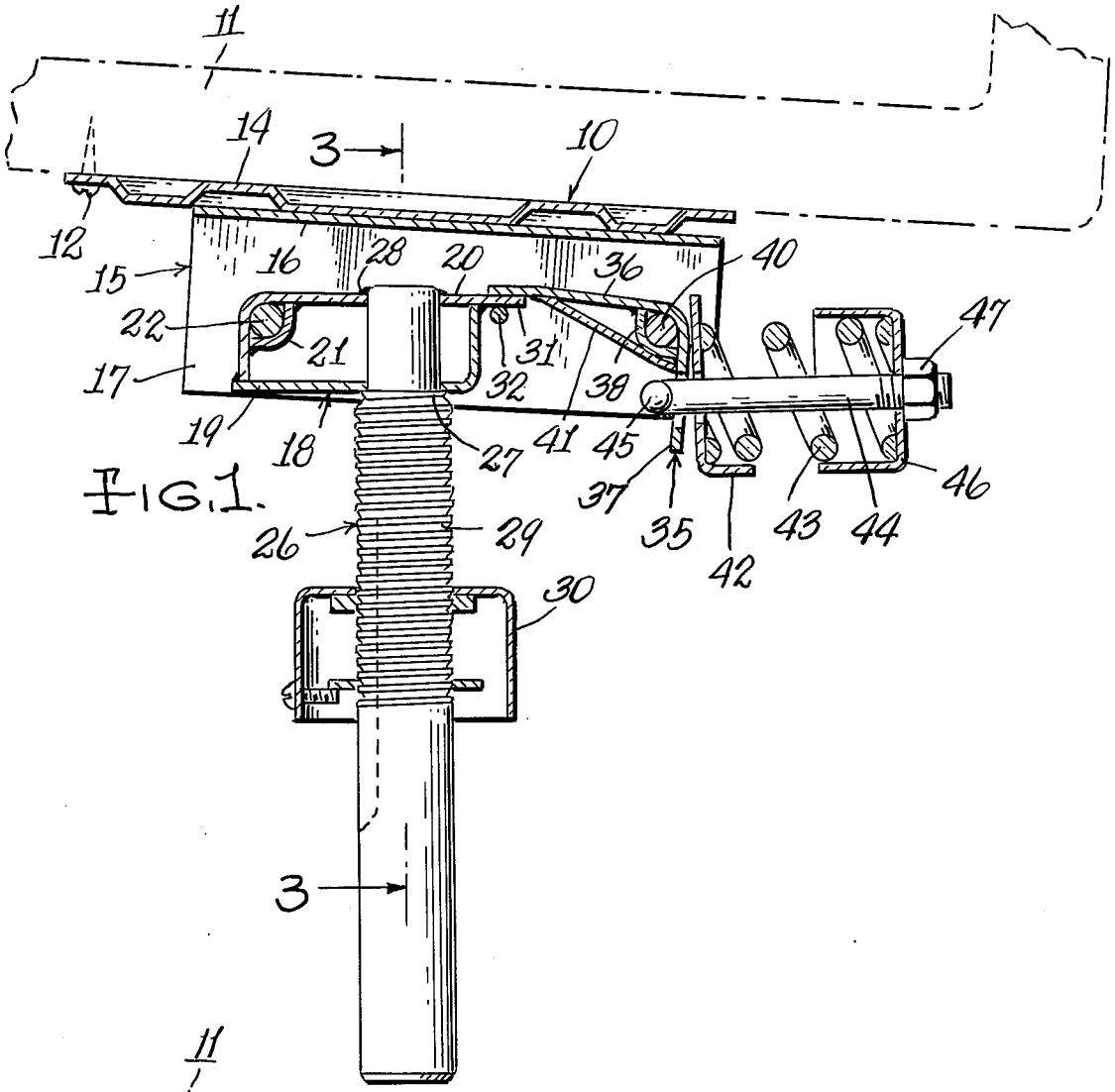
FIG. 1 is a vertical sectional view of a rocker fixture, illustrating a presently preferred embodiment of my invention.
Figure 4:
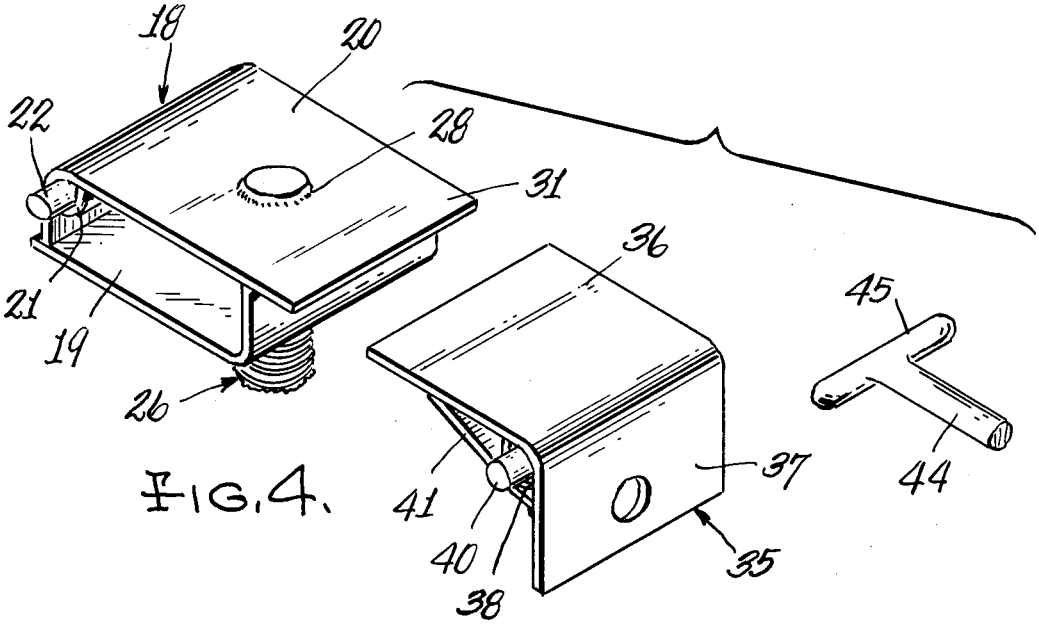
FIG. 4 is a separated perspective view of certain components of the rocker fixture.

Welded to the underside of the plate 10 is a support 15 which, in the disclosed embodiment, is in the form of an inverted channel having a web 16 and legs 17—17. A head bracket 18 is disposed between the legs 17 and pivoted thereto. As seen in FIGS. 1 and 4, the head comprises a welded fabrication of parts to provide spaced plates 19 and 20. A curved section 21 is welded to an inside corner of the joined plates 19 and 20 and cooperates therewith to form a socket for a pivot pin 22, the opposite ends of which are held in openings in the spaced legs 17—17. The inverted channel may therefore swing about the pin 22.

Extending through aligned openings in the plates 19 and 20 is the top part of a post 26. The post has a shoulder 27 engaging the undersurface of the plate 19 and the upper extremity of the post is welded to the upper surface of the plate 20, as seen at 28. Thus, the post 26 is rigidly joined to the bracket 18.

The post has screw threads 29 formed thereon for cooperation with a height adjusting nut 30 of the type shown in the Fox U.S. Pat. No. 2,463,257. The lower unthreaded end of the post fits into a socket (not shown) for swivel purposes. This construction is well known in the art and therefore need not be disclosed in detail.

As seen in FIG. 1, the plate 20 has an extending tail portion 31 which is engageable with a pin 32 to limit swinging movement of the channel in a counterclockwise relation. A bell crank lever 35 is disposed within the confines of the channel 15 and has a long arm 36 and a short arm 37. A curved section 38 is welded to an inside corner of the lever and cooperates therewith to form a socket for a pivot pin 40, the opposite ends of the latter being held in openings in the channel legs 17—17. A strut 41 is welded across the arms 36 and 37 to reenforce the same.

The terminal end of the arm 36 overlies the tail portion 31, as seen in FIG. 1. A crosspiece 42 is welded to and between the channel legs 17—17 and forms an abutment for one end of a compression spring 43. The arm 37 and crosspiece 42 are provided with openings to pass the shank 44 of a T-bolt. The head 45 of the bolt bears against the inside surface of the arm 37. A cup 46 receives the opposite end of the spring 43 and is apertured to pass the bolt shank, and a nut 47 is threaded upon the shank and determines the amount of compression of the spring.

Figure 2:
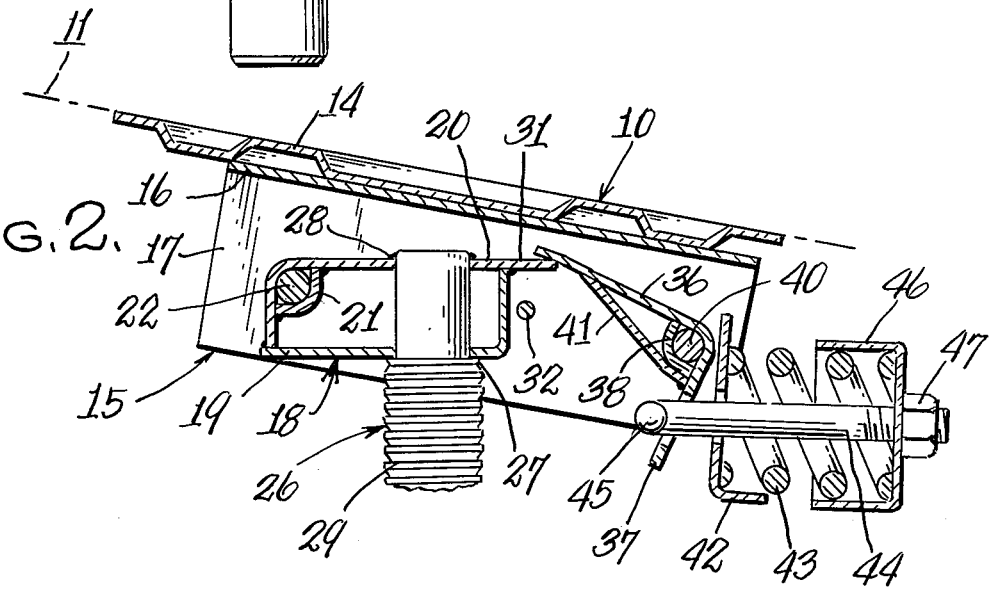
FIG. 2 is a section similar to FIG. 1 but showing the position of parts when the chair is in tilted position.
Figure 3:
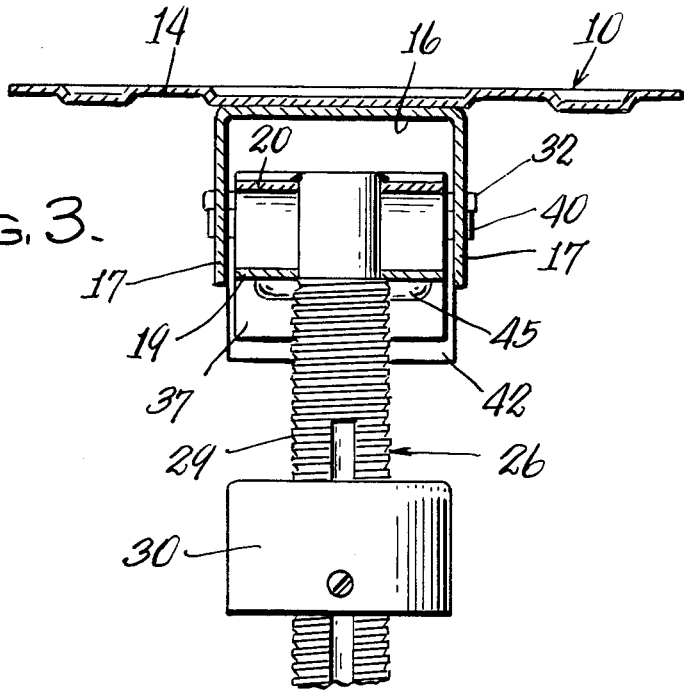
FIG. 3 is a sectional view, generally corresponding to the line 3—3 of FIG. 1.

As seen in FIG. 1, the terminal extremity of the arm 36 bears against the tail portion 31 to urge the channel 15 to swing counterclockwise and abut the stop pin against the tail portion. When weight is applied to the seat to swing it and the channel about the pivot pin 22 in a clockwise direction, the bell crank lever 35 will swing about the pivot pin 40 in a clockwise direction, as seen in FIG. 2, to further compress the spring 43.

It will be noted that the pivot pins 22 and 40 are on opposite sides of the longitudinal axis of the post and that the arm 36 and tail portion having sliding interengagement to provide a counterbalancing effect so that weight movement is required to tilt the chair seat both to a backward position and forward from such position and thus minimize the feeling of being pushed into upright position by spring action. A more restful and relaxing seating arrangement is thereby provided. Since spring movement is slight, there is no spring noise and spring failure is practically eliminated. A small amount of grease between the wiping portions of the tail 31 and arm 36 provide smoothness of action and eliminate noise. The stop pin 32 is also held in openings in the channel legs 17—17 and, as seen in FIG. 1, holds the channel 15 and the seat 11 at a slight angle to the horizontal when no tilting force is applied to the seat.

I claim:

1. A rocker fixture for a chair and adapted to be interposed between a floor-engaging base of said chair and a person-supporting seat of said chair, said fixture comprising:

a support adapted to be secured to the undersurface of said seat, an upright post adapted to have its lower end supported from said base, a head bracket secured to the upper end of said post, said bracket having a first pivotal connection with said support whereby when the latter is connected to said seat and said post is supported on said base, said support and said seat may be tilted about said first pivotal connection, a lever member having a second pivotal connection with said support, said lever member having a portion in abutting relation with a portion of said head bracket and slidable with respect thereto when said support is tilted about said first pivotal connection, and means for resiliently holding said lever member portion in abutting relation with said bracket portion in any position of said support.

2. The construction according to claim 1 wherein said lever member portion overlies said bracket portion and wherein said lever member is tilted about said second pivotal connection by tilting action of said support about said first pivotal connection.

3. The construction according to claim 3 wherein said lever member is of the ball crank type with the end of one arm constituting the portion overlying said bracket portion, the other arm of said bell crank being resiliently urged to pivot said bell crank about said second pivotal connection in a direction to urge said one arm end into abutment with said bracket portion.

4. The construction according to claim 1 wherein said first and second pivotal connections are disposed on opposite sides of the longitudinal axis of said post.

5. A rocker fixture for a chair and adapted to be interposed between a floor-engaging base of said chair and a person-supporting seat of said chair, said fixture comprising:

an inverted channel having a pair of spaced legs and a web connecting the same, said web being adapted for connection to the undersurface of said seat, an upright post adapted to have its lower end supported from said base, a head bracket secured to the upper end of said post, a first pivot pin having its opposite ends supported by said channel legs and its intermediate portion in bearing relation within a socket in said head bracket, whereby when said web is connected to said seat and said post is supported on said base, said channel and said seat may be tilted about said first pivot pin, a lever member, a second pivot pin having its opposite ends supported by said channel legs and its intermediate portion in bearing relation within a socket in said lever member, said lever member having a portion in abutting relation with a portion of said head bracket and slidable with respect thereto when said channel is tilted about said first pivot, and means resiliently holding said lever member portion in abutting relation with said bracket portion in any position of said channel.

6. The construction according to claim 5 wherein said lever member portion overlies said bracket portion and wherein said lever member is tilted about said second pivot pin by tilting action of said channel about said first pivot pin.

7. The construction according to claim 6 wherein a cross pin has its opposite ends supported by said channel legs and its intermediate portion disposed for abutment with said bracket portion to limit tilting action of said channel in one direction.

8. The construction according to claim 6 wherein said lever member is of the bell crank type with the end of one arm constituting the portion overlying said bracket portion, the other arm of said bell crank resiliently urged to pivot said bell crank about said second pivot pin in a direction to urge said one arm end into abutment with said bracket portion.

9. The construction according to claim 8 wherein both said head bracket and said bell crank lever are disposed within the confines of said channel legs.

10. The construction according to claim 5 wherein said first and second pivot pins are disposed on opposite sides of the longitudinal axis of said post.

11. The construction according to claim 10 wherein a plate is secured crosswise of said channel legs outwardly of said bell crank other arm and wherein the latter and said bracket have apertures for passing the shank of a T-bolt, the head of said bolt bearing against said other arm, and a coil spring about said bolt shank and having one end bearing against said plate, and a nut threaded on said bolt shank and adapted to compress said coil spring between it and said plate.

* * * * *